United States Patent [19]

Foshee

[11] Patent Number: 4,768,360

[45] Date of Patent: Sep. 6, 1988

[54] LOCK FOR SLIDING DOORS OR PANELS

[75] Inventor: William R. Foshee, Indianapolis, Ind.

[73] Assignee: Best Lock Corporation, Indianapolis, Ind.

[21] Appl. No.: 66,619

[22] Filed: Jun. 26, 1987

Related U.S. Application Data

[63] Continuation of Ser. No. 835,512, Mar. 3, 1986, Pat. No. 4,722,204.

[51] Int. Cl.[4] ..... E05B 65/08

[52] U.S. Cl. ..... 70/100; 70/360; 70/369

[58] Field of Search ..... 70/100, 371, 360, 361, 70/90, 95, 369

[56] References Cited

U.S. PATENT DOCUMENTS

| | | | |
|---|---|---|---|
| 535,915 | 3/1895 | Lubbe et al. | 70/100 |
| 1,050,692 | 1/1913 | Resch | 70/100 |
| 1,247,532 | 11/1917 | Heath . | |
| 1,342,728 | 6/1920 | Welch . | |
| 1,499,444 | 7/1924 | Caillois . | |
| 1,846,822 | 2/1932 | Vogt | 70/100 |
| 1,907,625 | 5/1933 | Vogt | 70/100 |
| 1,938,339 | 12/1933 | Keil | 70/100 |
| 2,131,315 | 9/1938 | Dunseath | 70/100 |
| 3,068,682 | 12/1962 | Russell et al. | 70/38 |
| 3,102,411 | 9/1963 | Friedman | 70/100 |
| 3,721,112 | 3/1973 | Wellekens | 70/39 |
| 3,798,935 | 3/1974 | Blekking et al. | 70/100 |
| 4,380,915 | 4/1983 | Kincaid et al. | 70/224 |
| 4,444,034 | 4/1984 | Best et al. | 70/369 |
| 4,722,204 | 2/1988 | Foshee | 70/100 |

FOREIGN PATENT DOCUMENTS

| | | |
|---|---|---|
| 1915618 | 10/1970 | Fed. Rep. of Germany . |
| 2748045 | 6/1978 | Fed. Rep. of Germany . |
| 3342458 | 6/1985 | Fed. Rep. of Germany . |
| 24307 | of 1896 | United Kingdom . |
| 1005853 | 9/1965 | United Kingdom . |

*Primary Examiner*—Lloyd A. Gall

*Attorney, Agent, or Firm*—Barnes & Thornburg

[57] ABSTRACT

A lock is provided for use in preventing relative movement of first and second sliding panels arranged in side-by-side passing relation. The lock includes a lock cylinder that is mounted in the first sliding panel and has an inner wall defining a core-receiving chamber. The lock further includes a lock core that has a slot for receiving a key and is slidably mounted in the core-receiving chamber for movement between a projected and retracted position. In its projected position, the lock core substantially blocks movement of the second sliding panel in relation to the first sliding panel. In its retracted position, the lock core permits unhindered movement of the second sliding panel in relation to the first sliding panel. In a first embodiment, the lock core includes separate first and second control lugs positioned in spaced-apart relation. In a second embodiment, the lock core includes a single control lug.

4 Claims, 2 Drawing Sheets

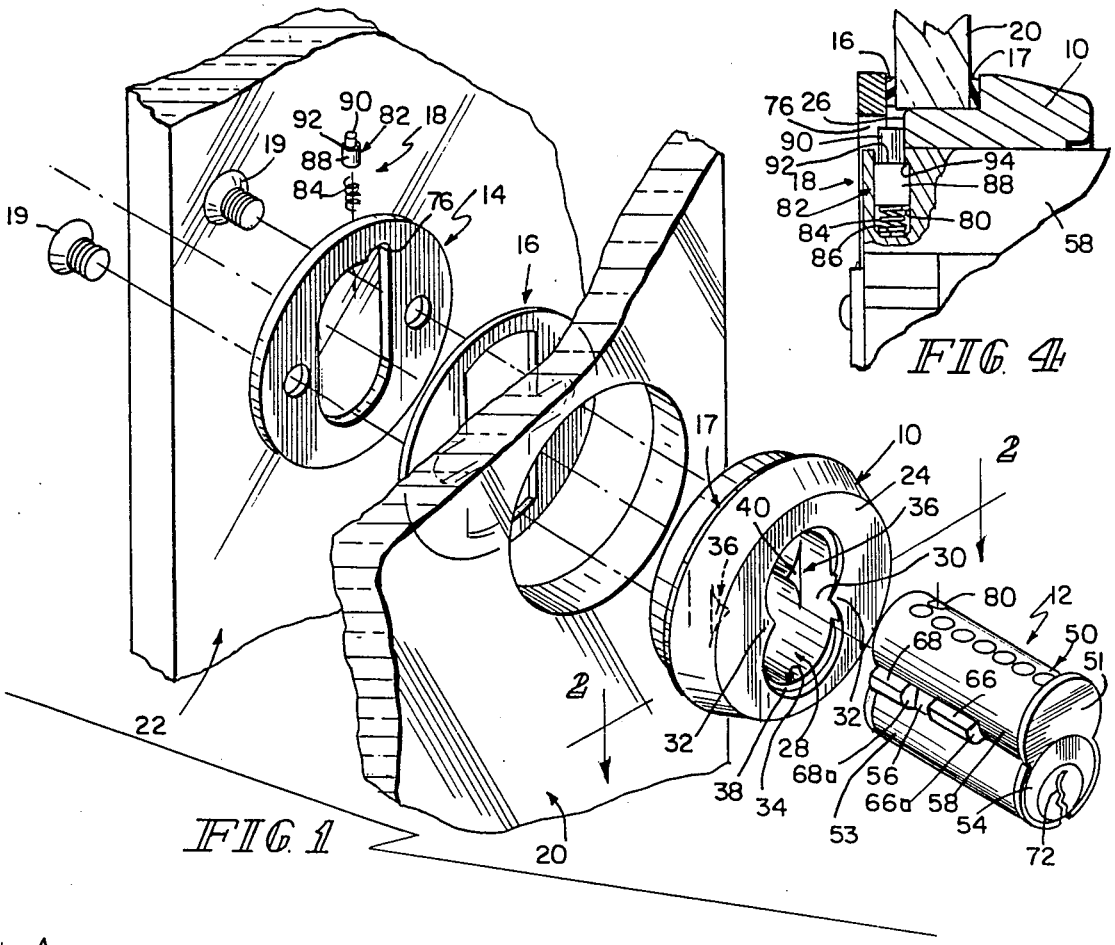
FIG. 1
FIG. 4
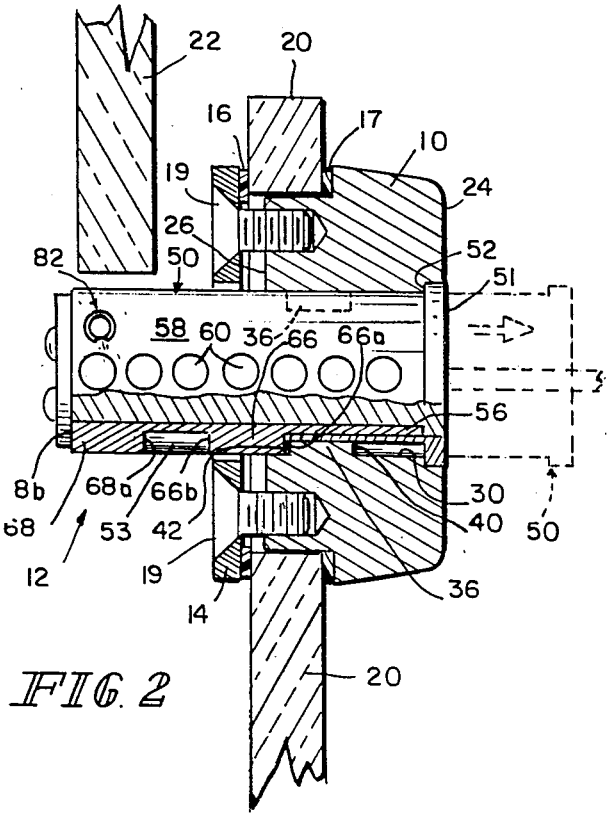
FIG. 2
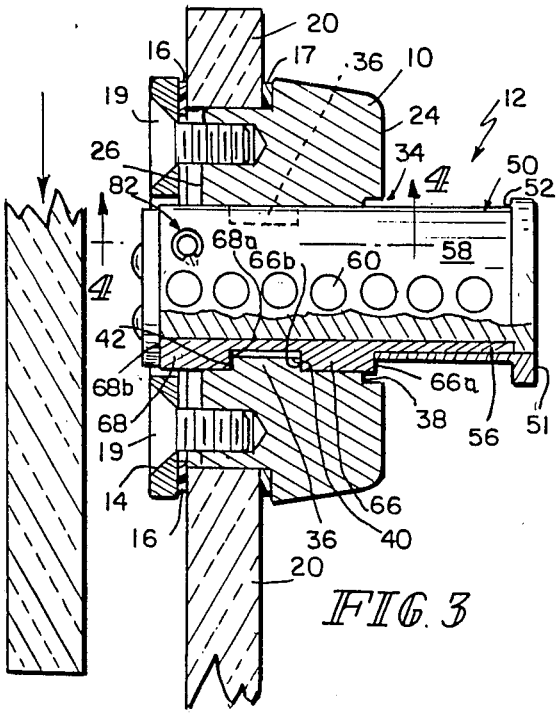
FIG. 3

LOCK FOR SLIDING DOORS OR PANELS

This is a continuation of application Ser. No. 835,512 filed Nov. 3, 1986 now U.S. Pat. No. 4,722,204.

BACKGROUND AND SUMMARY OF THE INVENTION

The present invention relates to a lock for sliding doors or panels. Particularly, the present invention relates to a sliding door lock having a lock cylinder that is mountable in a first sliding door and a lock core that is slidably extendable from its normal position within the lock cylinder to block movement of an adjacent second sliding door in relation to the first sliding door.

Push locks for sliding doors are known. Sliding doors are commonly locked by operating a push-button to project a bolt assembly from the face of one door into a keeper on the overlapping door. A representative push-button sliding door lock is disclosed in Blekking et al., U.S. Pat. No. 3,798,935. Although such a sliding door lock functions in the intended manner, it will be appreciated that it is necessary to: install a push button cylinder assembly on an outer sliding door or door frame, install a separate keeper mechanism in the adjacent inner sliding door, provide a bolt assembly for lockably engaging the keeper, provide a key-operated lock core and means for interconnecting the lock core and separate bolt assembly.

These added features required by the design of the '935 patent undesirably increase the cost and the complexity of the sliding door lock. It will be appreciated that the lock cylinder disclosed in the '935 patent is generally mounted in the base of the cabinet instead of in one of the sliding doors themselves since the sliding doors are typically made of glass and the known lock is not adapted for mounting in a glass door or panel. The base must be made undesirably heavy to accommodate and support such a lock cylinder. Typically, the lock is permanently installed in the frame or other base. One disadvantage of this arrangement is that the frame must be disassembled completely to remove the lock for maintenance reasons. It may also be necessary to mount the keeper assembly in a glass door which disfigures the inner sliding door and increases installation time. In addition, two separate keys must be provided to install and operate the lock core. The control key is used to fix the interchangeable lock core in the lock cylinder defined by a push-button plunger while the operating key is used to rotate the bolt assembly between its locking and release positions. The keys are removable only when the lock core is in its locked position.

Sliding panel locks are also known. One example is the 2P Series sliding panel lock sold by Best Lock Corporation of Indianapolis, Ind. Typically, a strike strap and a cylinder cooperate to form a blocking arrangement. The strike strap includes a hooked tongue at one end and securement means at the other end. When the panels are closed, the hooked tongue of the strike strap extends beyond the edge of the outer panel. To lock the inner and outer panels together, a pin in the lock core engages the securement means of the strike strap. Locking engagement of the lock core and the strike strap is accomplished by key operation of the lock core. A control key is used to fix the interchangeable lock core in the lock housing while an operating key is used to interengage the lock core pin and the securement means of the strike strap. This unit is entirely separate from the sliding panels. One disadvantage is that the unit comes apart into two pieces when the key is operated to withdraw the pin from the strike since the unit is not permanently attached to the sliding panels. The keys are removable only when the lock core is in its locked position.

A lock for sliding doors or panels that is easily mounted on one of the doors itself instead of on the door frame and that does not require that additional keepers or the like be mounted on the other door, is designed to receive a key-operated interchangeable lock core that is itself movable to block relative movement of a pair of sliding doors without additional keeper-engaging bolt assembly, and is adaptable to permit removal of the lock-operating key when the lock core is in either of its locked or unlocked positions would avoid the shortcomings of conventional lock systems.

According to the present invention, a lock is provided for use in preventing relative movement of first and second sliding panels arranged in side-by-side passing relation. The lock includes a lock cylinder that is mounted in the first sliding panel and has an inner wall defining a core-receiving chamber. The lock further includes a lock core that has a slot for receiving a key and is slidably mounted in the core-receiving chamber for movement between a projected and retracted position. In its projected position, the lock core substantially blocks movement of the second sliding panel in relation to the first sliding panel. In its retracted position, the lock core permits unhindered movement of the second sliding panel in relation to the first sliding panel.

The second sliding panel is movable along a path that is spaced-apart from the path of the first sliding panel in the customary way. However, in contrast to known locking systems, the lock core of the present invention is projectable from the lock cylinder mounted in the first sliding panel to intersect the path of the second sliding panel. Thus, the lock core itself may be positioned to intercept and engage an edge of the second sliding panel to block relative movement of the first and second sliding panels thereby locking the closed panels.

One feature of the present invention is the provision of a lock core slidably mounted in the core-receiving chamber for movement between a projected position substantially blocking movement of the second sliding panel in relation to a first sliding panel and a retracted position permitting unhindered movement of the second sliding panel in relation to the first sliding panel. This feature advantageously simplifies the construction and installation of the novel lock in comparison to known locks.

In construction, the actual panel-locking mechanism used in the present invention is defined by the lock core itself. A user can project the lock core initially positioned in an outer sliding panel into the path of an adjacent inner sliding panel to intercept and block the inner panel so that both panels are unable to slide open when the lock core is retained in its projected inner panel-locking position. The lock core advantageously provides a solid panel-blocking member and is easily adapted for use in a sliding door locking system since it is unnecessary to provide and assemble conventional panel-locking bolt and keeper mechanisms for interconnecting the panels and the lock core. Thus, the novel construction reduces the complexity of the lock thereby providing a more economical and efficient lock.

Installation is accomplished easily by mounting the lock cylinder in a hole cut in the outer sliding panel and then inserting the lock core into the mounted lock cylinder. It is unnecessary to provide additional brackets, straps, or the like as is customary in known sliding door locking systems since the lock core is slidable within the lock cylinder to block relative movement of two sliding panels. In addition, the lock cylinder can be mounted directly in a glass panel or the like. It is unnecessary to provide a heavy base or frame for supporting any part of the novel lock. One advantage of this feature is that installation of the novel lock in any existing panels is accomplished easily since it is only necessary to cut a cylinder-receiving hole in one of the existing panels. Thus, the versatile lock of the present invention can be mounted easily to lock display cabinets, window displays, or other storage areas that are closed by sliding panels of glass, plastic, wood or the like.

Another feature of the present invention is that the lock core is retainable in its projected panel-locking position by engagement of the lock core control lugs and the lock cylinder. This feature advantageously simplifies the operation of the lock. In operation, release of the lock core for axial movement between its projected panel-locking position and its retracted panel-unlocking position advantageously is accomplished solely by means of a single "control" key thereby avoiding the need for a separate "operating" key. The sliding panels are unlocked by rotating the control key to disengage the control lug in the lock cylinder and then pulling the lock core forward from its projected panel-locking position to its retracted panel-unlocking position.

Yet another feature of the present invention is that the sliding door lock is adaptable to permit removal of the lock-operating control key whether or not the lock core control lugs engage the lock cylinder lug to retain the lock core in a selected position within the lock cylinder. One advantage of the present invention is that the lock core is easily adapted to provide a "convenience version" as disclosed in a first embodiment or a "higher security version" as disclosed in a second embodiment without interfering with the novel panel-blocking function of the lock core itself. In the first embodiment, the lock core includes two separate control lugs to permit the key to be removable in the locked or unlocked position, whereas in the second embodiment the key is removable only in the locked position. The novel key-removal feature of the first embodiment is advantageous in that it is desirable in many instances to remove the key from the lock core. For example, in many retailing applications it is necessary to leave a display cabinet having sliding doors unlocked during business hours. In these situations, the security manager does not wish to permit a customer to steal the unattended key left in the key slot by simply returning the lock mechanism to its locked position and then removing the key.

Additional objects, features, and advantages of the invention will become apparent to those skilled in the art upon consideration of the following detailed description of the preferred embodiments exemplifying the best mode of carrying out the invention as presently perceived.

BRIEF DESCRIPTION OF THE DRAWINGS

The detailed description particularly refers to the accompanying figures in which:

FIG. 1 is an exploded assembly view of a lock illustrating a first embodiment of the invention;

FIG. 2 is an enlarged sectional detail view of the lock of FIG. 1 after assembly showing the lock core in its panel-blocking projected position;

FIG. 3 is a view similar to that shown in FIG. 2 showing the lock core in its unlocked, key-releasing, retracted position;

FIG. 4 is an enlarged sectional detail view; taken generally along the lines 4—4 of FIG. 3 with portions broken away to reveal a retaining pin assembly;

DETAILED DESCRIPTION OF THE DRAWINGS

Figure 5:
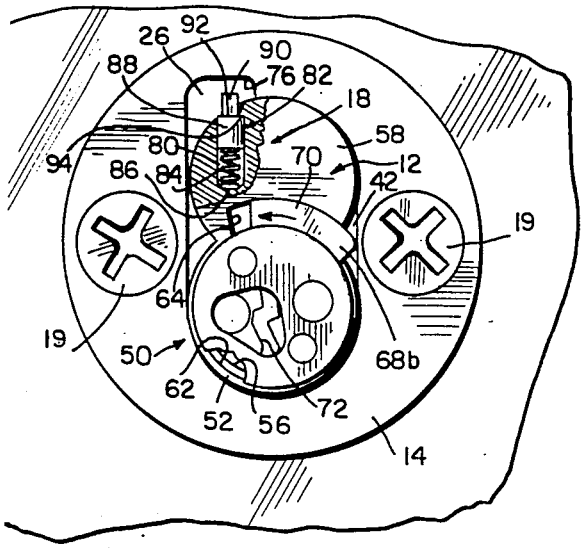
FIG. 5 is a detailed rear view of the lock of FIG. 3 with portions broken away.
Figure 6:
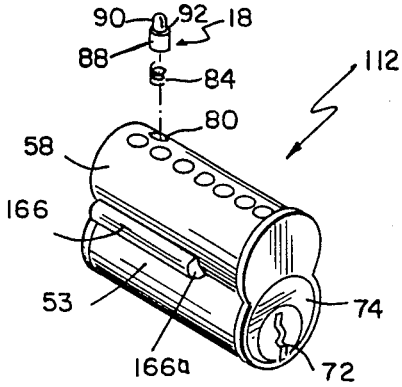
FIG. 6 is a perspective view of a lock core for use in conjunction with a second embodiment of the invention.

A first embodiment of the lock of the present invention is illustrated in FIGS. 1–5. In this first embodiment, the control means is configured to release the key from the slot when the lock core is in its retracted position thereby providing a "convenience version" of the lock. Thus, the key is conveniently removable from the slot in the lock core when the second sliding panel is movable in relation to the first sliding panel to permit safe storage of the key when the panels are unlocked. This "convenience version" is for use in situations where the lock is mounted in front of the display cabinet within the general public's reach and is left generally unattended during business hours.

The embodiment illustrated in FIGS. 1–5 includes a lock cylinder 10, an interchangeable lock core 12, a clamp plate 14, a clamp plate washer 16, a lock cylinder washer 17, a retaining pin assembly 18, and assembly bolts 19. Desirably, the washers 16 and 17 are made of vinyl or other similar material to provide a cushion so that the lock is mountable on glass doors or panels. The lock is mountable in a first sliding panel 20 and operable to block relative movement of the first sliding panel 20 and an adjacent second sliding panel 22. As is customary, the first and second sliding panels 20, 22 ride in tracks (not shown) which define two travel paths in spaced-apart parallel relation.

The lock cylinder 10 includes a forward face 24, a rearward face 26, and a core-receiving chamber 28 extending therebetween. The core-receiving chamber 28 is defined by an inner wall 30 of the lock cylinder 10 as shown best in Figs 1 and 2. The opening of the core-receiving chamber 28 in the forward face 24 of the lock cylinder 10 is of figure-8 shape to admit a lock core having a figure-8 cross-section. A pair of inwardly-projecting studs 32 are formed in the forward lock cylinder face 24 along an intersection line dividing the upper and lower portions of the forward chamber opening as shown best in FIG. 1.

The lock cylinder 10 further includes a lip 34 and a cylinder lug 36 that cooperate in a manner to be described below to aid in retaining the lock core 12 in selected projected and retracted positions within the core-receiving chamber 28 of the lock cylinder 10. The lip 34 is situated at the interface between the inner wall 30 and the forward face 24 and includes an oblong forwardly-facing surface 38 that substantially encircles the core-receiving chamber 28. The cylinder lug 36 is situated in the core-receiving chamber 28 between the 1lip 34 and the rearward face 26 of the lock cylinder 10 and is positioned on the inner wall 30 to extend into the interior of the core-receiving chamber 28. The cylinder lug 36 includes a forwardly-facing lug face 40 and a rearwardly-facing lug face 42 as shown best in FIGS. 2 and 3.

The interchangeable lock core 12 includes a core body 50. The core body 50 is desirably of figure-8 cross-section. The lock core 10 also includes a forward face 51 enlarged in relation to the remainder of the core body 50 to define an outwardly-extending peripheral flange 52 as shown best in FIGS. 2 and 3. Referring now to FIGS. 1–3, the core body 50 has a lower lobe 53 which contains a key plug 54 and a thin-walled core sleeve 56, and an upper lobe 58 which contains the pin tumblers or segments 60 and their biasing springs (not shown). The core body 50 is adapted to be mounted for sliding movement in the lock cylinder 10.

As shown best in FIG. 5, the lower lobe 53 of the core body 50 is formed with a cylindrical bore 62 in which the thin-walled core sleeve 56 is mounted for limited rotation. The cylindrical bore 62 is in open communication with a wide fantail slot 64 formed in the upper lobe 58. At the rear of the core body 50, the side wall of the slot 64 is milled away to pass a pair of spaced-apart core-retaining control lugs 66, 68 which are formed integral with a boss 70 on the core sleeve 56. The forwardmost control lug 66 includes a forwardly facing surface 66*a* and a rearwardly-facing surface 66*b*. The rearwardmost control lug 68 also includes a forwardly-facing surface 68*a* and a rearwardly-facing surface 68*b*.

The key plug 54 comprises a cylindrical body portion, desirably made from solid stock, which extends completely through the core sleeve 56 and has a close working fit within that sleeve. The key plug 54 is formed with an axial broached key slot 72. The key plug 54 is rotatably mounted within the core sleeve 56 in the customary way.

The core sleeve 56 is rotatable through an angle of 15° in a clockwise direction (as perceived by one turning the key) to rotate the pair of retaining lugs 66, 68 fixed to the core sleeve 56 from a core-retaining position projected away from the lock core 12 as shown in FIGS. 2, 3, and 5 to a core-releasing position (not shown) recessed within the lock core 12. Thus, core sleeve 56 is rotatable by means of a control key inserted into key slot 72 to permit the interchangeable lock core to be released and then slid in the core-receiving chamber 28 between a projected position shown in FIG. 2 and a retracted position shown in FIG. 3.

The retaining pin assembly 18 is mounted in a bore 80 formed in a rearward portion of the upper lobe 58 as shown best in FIGS. 4 and 5. The retaining pin assembly 18 includes a retaining pin 82 that is slidable within bore 80 and a spring 84 positioned on the bottom wall 86 of the bore 80 to bias the retaining pin 82 upwardly toward a projected position into a pin-receiving rear 76 as shown in FIGS. 4 and 5.

The pin-receiving recess 76 has an opening adjacent to the rearward portion of the lock cylinder 10 as shown best in FIG. 4; The retaining pin 82 includes a cylindrical base 88 and a cylindrical blocking member 90. Preferably, the diameter of the base 88 exceeds the diameter of the blocking member 90 to define a flange 92 as shown best in FIG. 5. The retaining pin assembly 18 is secured in the base 80 by staking the portion of the upper lobe 58 surrounding the opening of the bore 82 to define a flange-engaging lip 94. The flange-engaging lip 94 traps the base 88 in the bore 80 while permitting the smaller diameter blocking member 90 to extend beyond the exterior surface of the core body 50 a sufficient distance into a pin-receiving recess 76 to engage the rearward face 26 of the lock cylinder 10 as shown best in FIGS. 4 and 5.

In an alternative embodiment (not shown), a retaining pin is defined by a setscrew threaded to engage a threaded interior surface of bore 80. The outermost end of the setscrew includes a hexagonal aperture for receiving an allen wrench or other similar tool. Using such a tool, the setscrew is rotatable in threaded bore 80 to a blocking position for engaging the rearward face 26 of the lock cylinder 10. This embodiment provides a "fixed position" retaining pin that can serve as a replacement for the "sliding position" retaining pin assembly 18 to aid in preventing removal of the core body 50 from its position in FIG. 4.

In operation, the embodiment illustrated in FIGS. 1–5 advantageously permits a user to withdraw the lock-operating control key from key slot 72 when the panel-blocking lock core 12 is in either its locked, projected position shown in FIG. 2 or its unlocked, retracted position shown in FIG. 3. In either instance, the novel construction of the present lock enables a security manager to remove the key from the key slot 72 for safe storage elsewhere.

In its locked projected position, the lock core 12 is held in place by engagement of (1) the lip 34 on the lock cylinder 10 and the flange 52 on the lock core 12, and (2) the rearward face 42 of cylinder lug 36 and the forward face 66*a* of core-retaining lug 66. In this position, the lock core 12 itself blocks relative movement of sliding panels 20 and 22. The lock core 12 is freed from this position by clockwise rotation of the core-retaining lug pair 66, 68 to their position (not shown) recessed within the core body 50. The user may then pull the lock core 12 in the direction indicated by the broken line arrows of FIG. 2 to its unlocked retracted position shown in FIG. 3.

In its unlocked retracted position, the lock core 50 is held in place by: (1) entrapment of the cylinder lug 36 between the rearward face 66*b* of core-retaining lug 66 and the forward face 68*a* of core-retaining lug 68, and (2) engagement of blocking member 90 of retaining pin 82 and the rearward face 26 of the lock cylinder 10. In this position, the lock core 12 does not block relative movement of sliding panels 20 and 22. The lock core 12 may be removed completely from the core-receiving chamber 28 of the lock cylinder 10 by rotating the core-retaining lugs 66, 68 to their recessed positions and then depressing the retaining pin 82 against biasing spring 84 into a position wholly within the retaining pin bore 80. In this way, the lugs 66, 68 and the blocking member 90 of the retaining pin 82 do not inhibit withdrawal of the core 12 from the lock cylinder 10.

Advantageously, the key plug 54 and the core sleeve 56 are rotated to their key-releasing positions when the lock core 12 is in its unlocked retracted position. In particular, the space defined between the two axially spaced-apart core-retaining lugs 66, 68 permits the core sleeve 56 to rotate without interference to its key-releasing position and at the same time provide a core-retaining trap for the cylinder lug 36.

Heretofore, locks for use with sliding panels not designed to release the key when moved to the unlocked position. For reasons of security in key control, security managers could not leave cabinets having such locks unattended since passersby could easily gain possession of the key by returning the core to its locked position to release the key. However, this shortcoming is avoided in the present invention since the embodiment of the novel lock shown in FIGS. 1–5 is constructed to permit a security manager to withdraw the key when the lock core is in its unlocked position. Removal of the key conveniently permits the security manager to store the key elsewhere during business hours when the display case or other cabinet is left unattended.

In a second embodiment of the invention illustrated in FIGS. 6–10, those elements referenced by numbers identical to those in FIGS. 1–5 perform the same or similar function. In a second embodiment of the present invention, control means is also provided for retaining the lock core in its retracted position in the lock cylinder in response to rotation of a key inserted into the key slot. In contrast to the first embodiment, the control means of the second embodiment is configured to retain the key in the slot when the lock core is in its retracted position thereby providing a "higher security version" of the lock. Thus, the key is not removable from the slot in the lock core when the second sliding panel is movable in relation to the first sliding panel. This "higher security version" is for use in situations where the lock is mounted behind the display cabinet out of the general public's reach and is monitored continually by retailing personnel or the like.

In the embodiment illustrated in FIGS. 6–10, the lock-operating control key is not removable when the core is in its unlocked, retracted position due to the construction of interchangeable lock core 112. This lock core 112 is substantially similar to the lock core 12 of the first embodiment with the exception that a single elongated core-retaining control lug 166 is formed on the core sleeve instead of the previously described pair of spaced-apart control lugs 66, 68. Control lug 166 includes forward face **166*a***.

Figure 7:
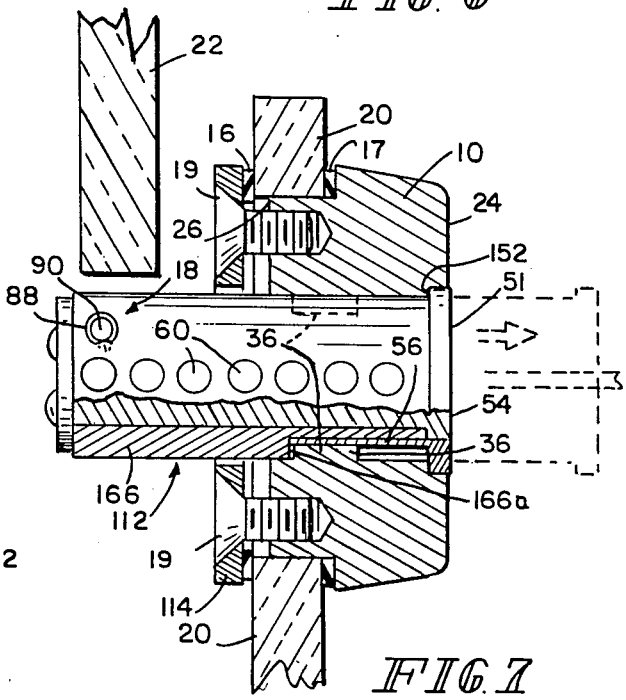
FIG. 7 is a sectional detail view of the second embodiment of the invention showing the lock core in its panel-blocking projected position.
Figure 9:
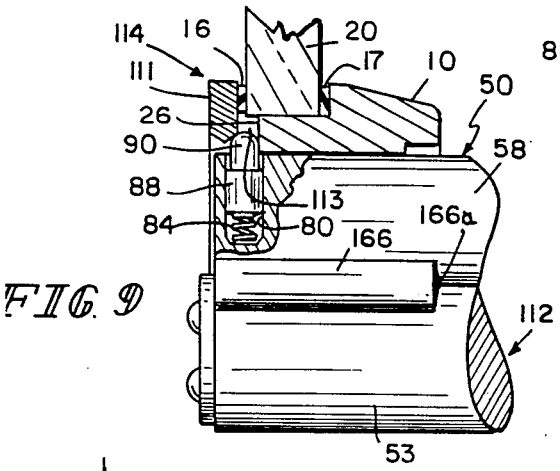
FIG. 9 is a view of the second embodiment of the invention taken generally along lines 9—9 of FIG. 8 with portions broken away to reveal a retaining pin assembly.

In its locked projected position shown in FIG. 7, the lock core 112 is held in place by engagement of: (1) the lip 34 on the lock cylinder 10 and an outwardly-extending peripheral flange 152 on the lock core 112, and (2) the rearward face 42 of cylinder lug 36 and the forward face **166*a* of the core-retaining control lug 166. In this position, the lock core 112 itself blocks relative movement of sliding panels 20 and 22. The lock core 112 is freed from this position by rotation of the core-retaining control lug 166 to its position (not shown) recessed within the core body 50. The user may then pull the lock core 112 in the direction indicated by the broken line arrows of FIG. 7 to its unlocked retracted key-retaining position shown in FIG. 8**. In these respects, the operation of the first and second embodiments of the present invention is the same.

Figure 8:
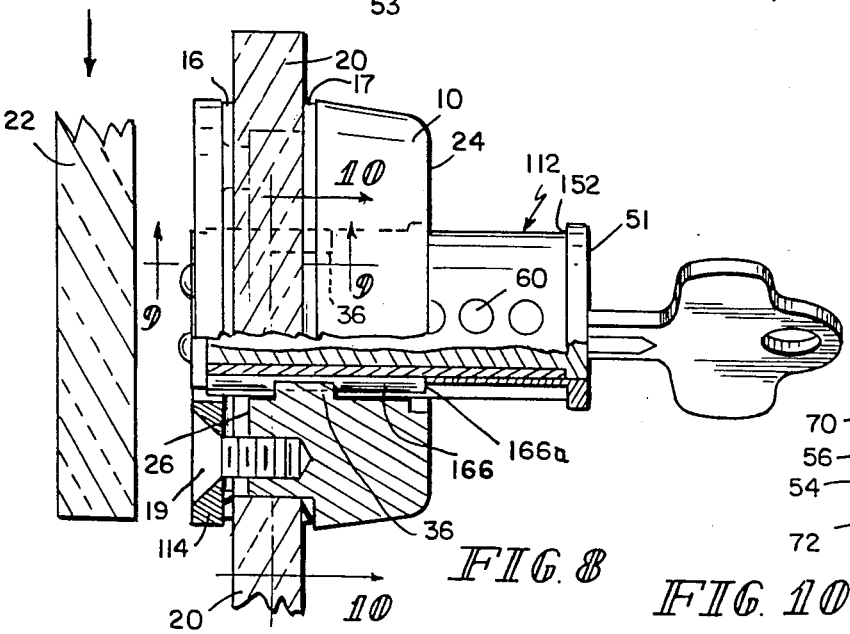
FIG. 8 is a view similar to that shown in FIG. 7 showing a lock core in its unlocked, key-retaining, retracted position.
Figure 10:
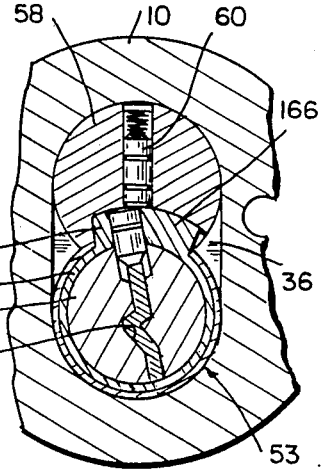
FIG. 10 is a view of the second embodiment of the invention taken generally along lines 10—10 of FIG. 8 showing engagement of the control lug and the cylinder lug to prevent rotation of the core sleeve to a key-releasing position.

In its unlocked, retracted, key-retaining position, the lock core 112 is held in place by trapping the upwardly-biased retaining pin in a groove or pin-receiving recess 113 defined by rearward face 26 of the lock cylinder 10 in cooperation with a downwardly-extending protrusion 111 formed on clamp plate 114. In this embodiment, the control lug 166 does not aid in retaining the lock core 112 in its unlocked retracted position. Instead, as best seen in FIGS. 8 and 10, the elongated control lug 166 engages the inwardly-extending cylinder lug 36 to prevent full rotation of the control lug 166 to its core-retaining position. Thus, cylinder lug 36 operates to block movement of core sleeve 56 to its key-releasing position as shown best in FIG. 10. Such a feature causes the key to be retained within the lock when the lock core 112 is in its retracted position as shown in FIG. 8.

Although the invention has been described in detail with reference to certain preferred embodiments, variations and modifications exist within the scope and spirit of the invention as described and defined in the following claims.

What is claimed is:

1. In first and second sliding panels arranged in side-by-side passing relation, the first sliding panel having a back face presented toward the second sliding panel and a front face and being formed to include an aperture extending between the front and back faces thereof, the second sliding panel sliding along a path and including an edge, a lock for use in preventing relative movement of the first and second sliding panels, the lock comprising a lock cylinder having an inner wall defining a core-receiving chamber, the lock cylinder being mounted in the aperture of the first sliding panel so that the core-receiving chamber extends from the front face toward the back face, and a lock core including core-combinating means including a plurality of tumbler pins arranged in a predetermined manner to defined a security combination of the core, the lock core being slidably mounted in the core-receiving chamber and movable between a projected position, the lock core in its projected position extending beyond the back face of the first sliding panel to situate a portion of the core-combinating means in a position outside of the core-receiving chamber of the lock cylinder and to engage the edge of the second sliding panel, thereby blocking movement of the second sliding panel along its path relative to the first sliding panel toward a predetermined destination, the lock core in its retracted position being positioned in the core-receiving chamber to permit unhindered movement of the second sliding panel along its path relative to the first sliding panel.

2. The lock of claim 1, wherein the lock core includes forward and rearward portions, the core-combinating means is housed at least in the rearward portion, and the rearward portion is positioned outside of the core-receiving chamber of the lock cylinder in the projected position of the lock core and inside the core-receiving chamber of the lock cylinder in the retracted position of the lock core.

3. In first and second sliding panels arranged in side-by-side passing relation, the first sliding panel having a back face presented toward the second sliding panel and a front face and being formed to include an aperture extending between the front and back faces thereof, the second sliding panel sliding along a path and including an edge, a lock for use in preventing relative movement of the first and second sliding panels, the lock comprising a lock cylinder having an inner wall defining a core-receiving chamber, the lock cylinder being mounted in the aperture of the first sliding panel so that the core-receiving chamber extends from the front face toward the back face, and a lock core slidably mounted in the core-receiving chamber and movable relative to the lock cylinder between projected and retracted positions, the lock core including a core body and control lug means movable relative to the core body for selectively engaging the lock cylinder to retain the lock core in its retracted position within the lock cylinder, the lock core in its projected position extending beyond the back face of the first sliding panel to situate a portion of the core body and control lug means in a position outside of the core-receiving chamber of the lock cylinder and to engage the edge of the second sliding panel, thereby blocking movement of the second sliding panel along its path relative to the first sliding panel toward a predetermined destination, the lock core in its retracted position being positioned in the core-receiving chamber to permit unhindered movement of the second sliding panel along its path relative to the first sliding panel.

4. The lock of claim 3, wherein the lock core includes forward and rearward portions, the control lug means is housed at least in the rearward portion, and the rearward portion is positioned outside of the core-receiving chamber of the lock cylinder in the projected position of the lock core and inside the core-receiving chamber of the lock cylinder in the retracted position of the lock core.

* * * * *